US010806243B2

(12) United States Patent
Barozzi

(10) Patent No.: US 10,806,243 B2
(45) Date of Patent: Oct. 20, 2020

(54) SYNTHETIC FIBER EMULATING PONY HAIR CHARACTERISTICS

(71) Applicant: ANISA INTERNATIONAL, INC., Atlanta, GA (US)

(72) Inventor: Eleonora Benedetta Barozzi, Atlanta, GA (US)

(73) Assignee: Anisa International, Inc., Atlanta, GA (US)

( * ) Notice: Subject to any disclaimer, the term of this patent is extended or adjusted under 35 U.S.C. 154(b) by 342 days.

(21) Appl. No.: 15/446,509

(22) Filed: Mar. 1, 2017

(65) Prior Publication Data

US 2017/0251798 A1 Sep. 7, 2017

Related U.S. Application Data

(60) Provisional application No. 62/303,553, filed on Mar. 4, 2016.

(51) Int. Cl.

| | |
|---|---|
| ***A46B 9/06*** | (2006.01) |
| ***A46B 3/10*** | (2006.01) |
| ***A46B 9/02*** | (2006.01) |

(52) U.S. Cl.

CPC ..... *A46B 9/06* (2013.01); *A46B 3/10* (2013.01); *A46B 9/021* (2013.01); *A46B 2200/1046* (2013.01)

(58) Field of Classification Search

CPC ..... A46B 9/06; A46B 9/021; A46B 7/04

See application file for complete search history.

(56) References Cited

U.S. PATENT DOCUMENTS

| | | | | |
|---|---|---|---|---|
| 2,687,979 | A * | 8/1954 | Anselm Talalay | B29D 99/0092 156/253 |
| 4,483,036 | A * | 11/1984 | Sayklay | A46B 9/02 15/160 |
| 4,998,315 | A * | 3/1991 | Pessis | A45D 40/265 132/320 |
| 6,324,716 | B1 * | 12/2001 | Holmes | A46B 5/06 15/113 |
| 6,367,114 | B1 * | 4/2002 | Babkowski | A46B 9/06 15/207.2 |
| 9,089,200 | B2 * | 7/2015 | Telwar | A46B 3/08 |
| 9,267,238 | B2 * | 2/2016 | Grove, III | D04H 1/4209 |

(Continued)

FOREIGN PATENT DOCUMENTS

WO 2017151902 9/2017

OTHER PUBLICATIONS

Barozzi, Eleonora Silvia Benedetto; International Preliminary Report on Patentability for PCT/US17/20423, filed Mar. 2, 2017, dated Sep. 13, 2018, 9 pgs.

(Continued)

*Primary Examiner* — Michael D Jennings

(74) *Attorney, Agent, or Firm* — Taylor English Duma LLP

(57) ABSTRACT

Disclosed is a concept of a synthetic fiber substitute for pony hair, for use in cosmetic brushes or the like, made of PBT, with a mix of two diameters of fibers, 0.05 mm diameter and 0.07 mm diameter, with the ratio of the blend being 8:2 (8 parts 0.05 mm diameter and 2 parts 0.07 mm diameter). The tips used on both types of fibers is a "short tip", and the wave characteristic of both types of fibers is "small wave".

26 Claims, 6 Drawing Sheets

(56) References Cited

U.S. PATENT DOCUMENTS

| | | | | |
|---|---|---|---|---|
| 2007/0151061 | A1* | 7/2007 | Mink | A46B 9/021 15/160 |
| 2008/0141479 | A1* | 6/2008 | Mink | A46B 9/021 15/207.2 |
| 2010/0037407 | A1 | 2/2010 | Telwar | |
| 2010/0077559 | A1 | 4/2010 | Mink | |
| 2011/0034561 | A1* | 2/2011 | Nakamura | A46B 15/00 514/643 |
| 2012/0116147 | A1 | 5/2012 | Lim | |
| 2014/0030946 | A1* | 1/2014 | Grove, III | D04H 13/008 442/60 |
| 2014/0153995 | A1* | 6/2014 | Lhoyer | A46B 9/021 401/129 |

OTHER PUBLICATIONS

Iernational Searching Authority, ISR and Written Opinion for International Appn No. PCT/US2017020423, dated Mar. 2, 2017, 10 pages, Korean IPO, Republic of Korea.

* cited by examiner

Fig. 5

First Preferred Embodiment

| First Fiber | Second Fiber | Ratio of First Fiber to Second Fiber |
|---|---|---|
| 0.05 mm diameter PBT<br>40 mm long<br>Small wave<br>Short tip | 0.07 mm diameter PBT<br>40 mm long<br>Small wave<br>Short tip | 8:2 |

"Short Tip" dimensions

*0.05mm diameter fiber*

*0.07mm diameter fiber*

"Small Wave" dimensions

SYNTHETIC FIBER EMULATING PONY HAIR CHARACTERISTICS

CROSS-REFERENCE TO RELATED APPLICATIONS

The present application claims all benefit and priority to U.S. Provisional Patent Application No. 62/303,553, filed Mar. 4, 2016, and fully incorporates the contents of said application and its entire file history.

BACKGROUND

Technical Field

This disclosure relates to new fibers such as used in cosmetic brushes or the like.

BRIEF SUMMARY

The present invention relates to a new synthetic fiber which emulates natural pony hair, and which may be used as a substitute for natural pony hair in cosmetic brushes or the like. The invention also relates to methods for providing same.

Generally described, the disclosure relates to one or more embodiments of a cosmetic brush head and/or cosmetic brush assembly, including a cosmetic brush head and/or cosmetic brush assembly as disclosed in the claims as filed.

One embodiment may include a cosmetic brush head, said brush head comprising a blend of two fibers, said blend comprising: a first plurality of fibers each having a predetermined length and a 0.05 mm diameter; and a second plurality of fibers each having a predetermined length and a 0.07 mm diameter, wherein the ratio of said blend being 8:2 (8 parts 0.05 mm diameter to 2 parts 0.07 mm diameter).

Another aspect of the present disclosure may include the cosmetic brush head as described above, wherein at least one of said plurality of fibers includes individual fibers each made of a synthetic material.

Another aspect of the present disclosure may include the cosmetic brush head as described above, wherein at least one of said plurality of fibers includes individual fibers each made of a synthetic material.

Another aspect of the present disclosure may include the cosmetic brush head as described above, wherein at least one of said plurality of fibers includes individual fibers each made of Polybutylene Terephthalate (PBT).

Another aspect of the present disclosure may include the cosmetic brush head as described above, wherein each of said plurality of fibers includes individual fibers each made of Polybutylene Terephthalate (PBT).

Another aspect of the present disclosure may include the cosmetic brush head as described above, wherein at least one of said plurality of fibers includes individual fibers each having a short tip at its working end.

Another aspect of the present disclosure may include the cosmetic brush head as described above, wherein each of said plurality of fibers includes individual fibers each having a short tip at its working end.

Another aspect of the present disclosure may include the cosmetic brush head as described above, wherein at least one of said plurality of fibers includes individual fibers each having a small wave characteristic.

Another aspect of the present disclosure may include the cosmetic brush head as described above, wherein each of said plurality of fibers includes individual fibers each having a small wave characteristic.

Another aspect of the present disclosure may include the cosmetic brush head as described above, wherein each of said plurality of fibers includes individual fibers each having a small wave characteristic wherein the small wave characteristic is 1.5 mm from top to bottom and the length of each wave is 1.6 mm.

Another embodiment may include a cosmetic brush head, said brush head comprising a blend of two fibers, said blend comprising: a first plurality of fibers each having a predetermined length and a 0.05 mm diameter; and a second plurality of fibers each having a predetermined length and a 0.07 mm diameter, wherein the ratio of said blend being 8:2 (8 parts 0.05 mm diameter to 2 parts 0.07 mm diameter) and wherein said first and second pluralities of fibers are intermixed.

Another aspect of the present disclosure may include the cosmetic brush head as described above, wherein at least one of said plurality of fibers includes individual fibers each made of a synthetic material.

Another aspect of the present disclosure may include the cosmetic brush head as described above, wherein each of said plurality of fibers includes individual fibers each made of a synthetic material.

Another aspect of the present disclosure may include the cosmetic brush head as described above, wherein at least one of said plurality of fibers includes individual fibers each made of Polybutylene Terephthalate (PBT).

Another aspect of the present disclosure may include the cosmetic brush head as described above, wherein each of said plurality of fibers includes individual fibers each made of Polybutylene Terephthalate (PBT).

Another aspect of the present disclosure may include the cosmetic brush head as described above, wherein at least one of said plurality of fibers includes individual fibers each having a short tip at its working end.

Another aspect of the present disclosure may include the cosmetic brush head as described above, wherein each of said plurality of fibers includes individual fibers each having a short tip at its working end.

Another aspect of the present disclosure may include the cosmetic brush head as described above, wherein at least one of said plurality of fibers includes individual fibers each having a small wave characteristic.

Another aspect of the present disclosure may include the cosmetic brush head as described above, wherein each of said plurality of fibers includes individual fibers each having a small wave characteristic.

Another aspect of the present disclosure may include the cosmetic brush head as described above, wherein each of said plurality of fibers includes individual fibers each having a small wave characteristic wherein the small wave characteristic is 1.5 mm from top to bottom and the length of each wave is 1.6 mm.

Other aspects and advantages of the present disclosure will become obvious to the reader and it is intended that these objects and advantages are within the scope of the present invention.

ELEMENT LIST

Here is a list of the various elements:

10 Brush Assembly
- 20 Bristles
  - 22 Individual Bristles (aka bristle elements)
- 30 Ferrule
- 40 Handle

BRIEF DESCRIPTION OF THE DRAWINGS

FIG. 5 is a chart showing the specifications of a first preferred embodiment synthetic fiber substitute for pony hair according one of the present inventions.

DETAILED DESCRIPTION

The present invention now will be described more fully hereinafter with reference to the accompanying drawings, in which some, but not all embodiments of the inventions are shown. This invention may be embodied in many different forms and should not be construed as limited to the embodiments set forth herein; rather, these embodiments are provided so that this disclosure will satisfy applicable legal requirements. Like numbers refer to like elements throughout.

Reference is now made to the figures, in which like elements indicate like elements throughout the several views.

General Operating Environment

Figure 1:
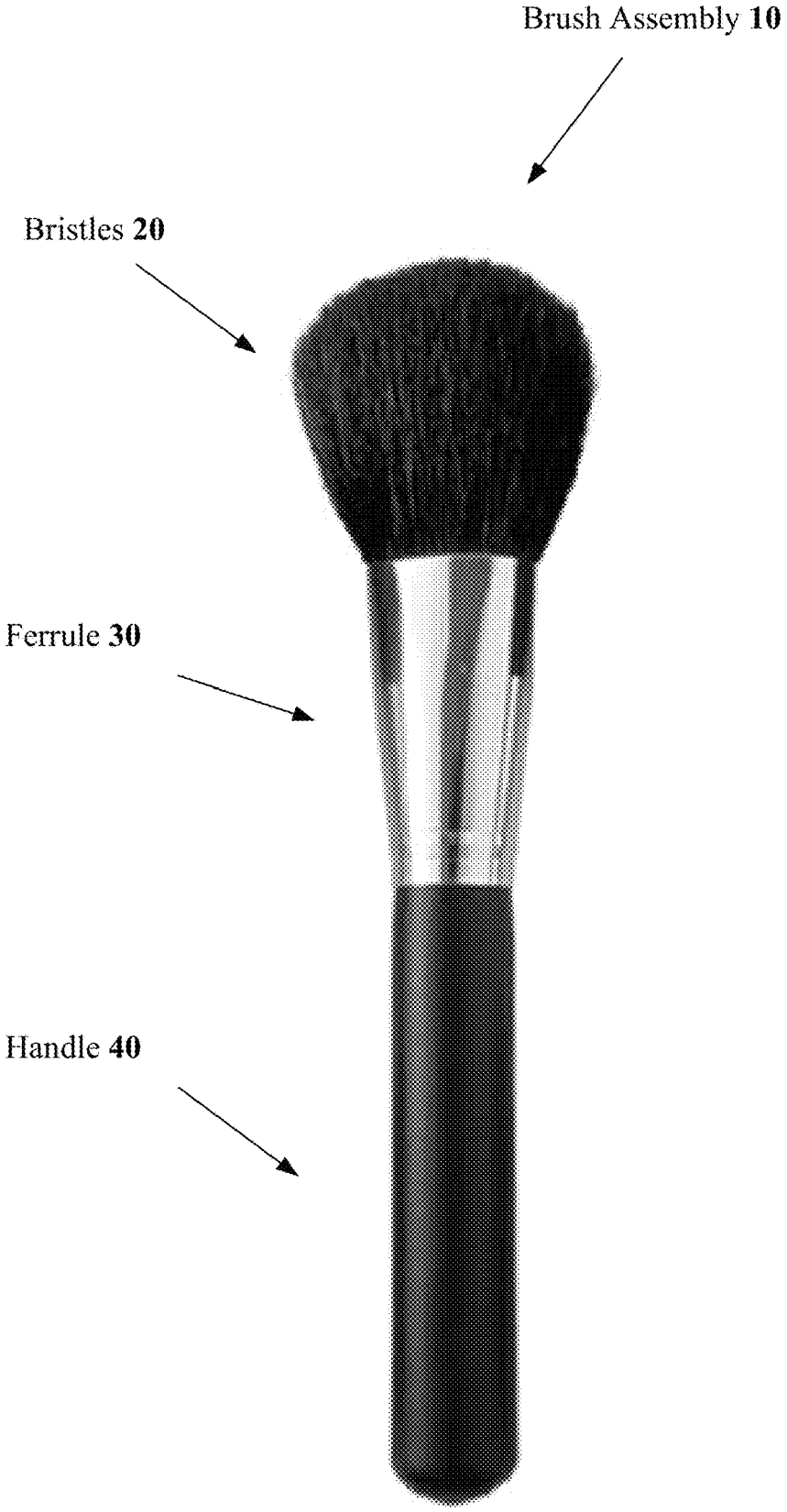
FIG. 1 illustrates an exemplary cosmetic brush assembly 10, including bristles 20, a ferrule 30, and a handle 40. The bristles 20 comprise a plurality of bristle elements (aka individual bristles, aka individual fibers).
Figure 2:
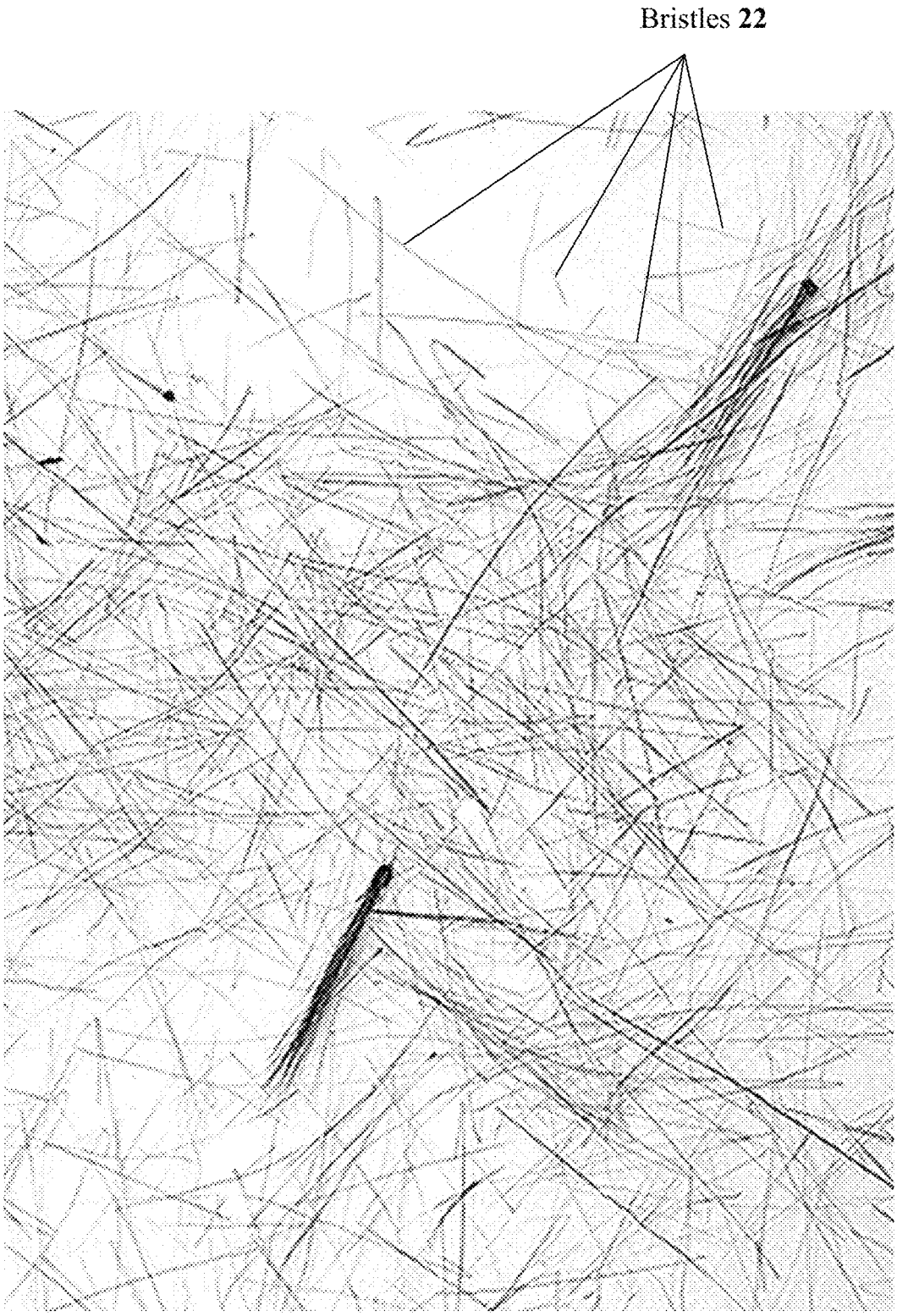
FIG. 2 shows exemplary individual bristles 22 scattered atop a supporting surface.
Figure 3:
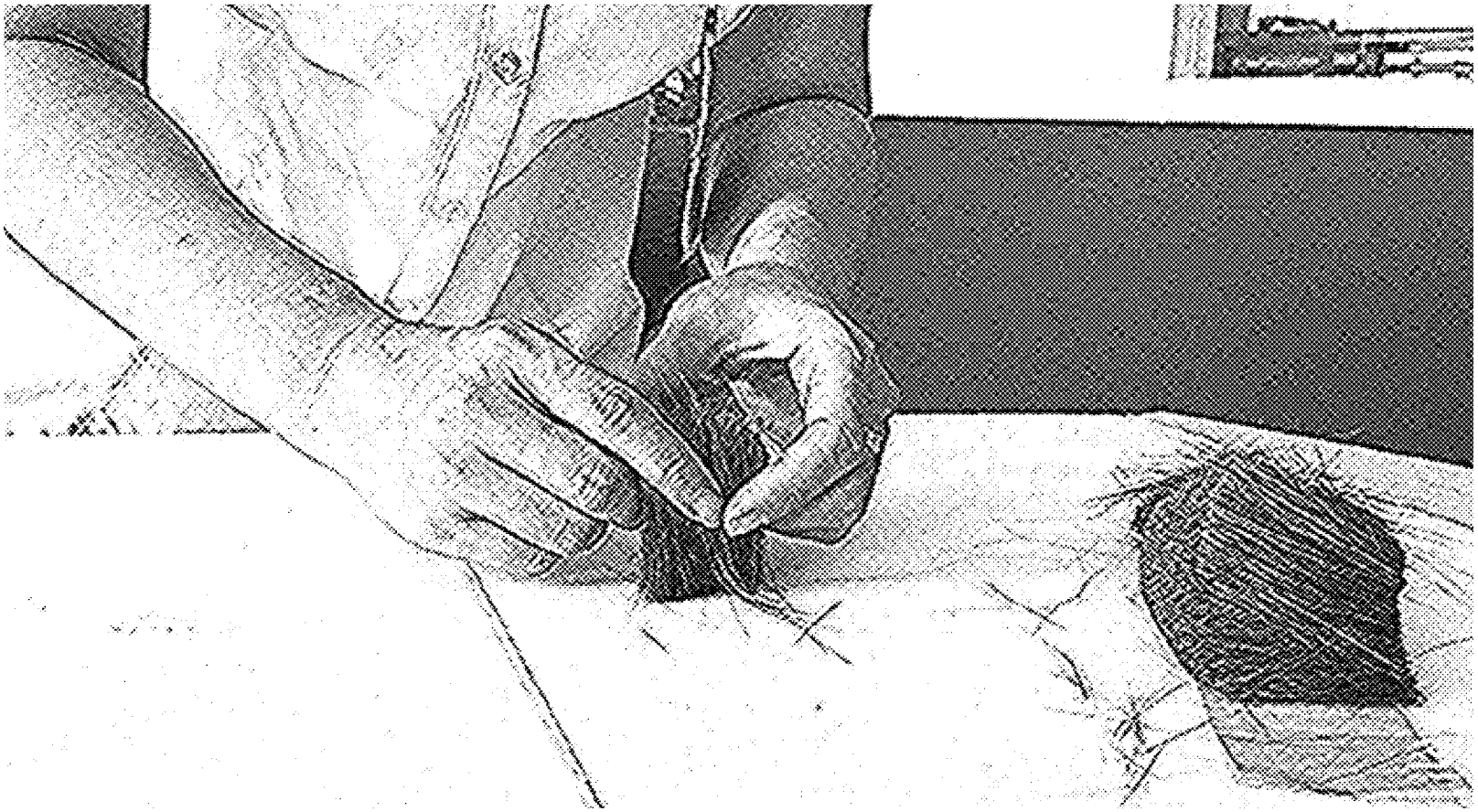
FIG. 3 shows a plurality of exemplary individual bristles 22 being gathered together for use in a cosmetic brush.

As will be seen, discussion will be made herein regarding bristles for use in cosmetic brushes of the like. Reference is made to FIG. 1, which shows the general operating environment of said bristles. FIG. 1 illustrates an exemplary cosmetic brush assembly 10, including bristles 20, a ferrule 30, and a handle 40. The bristles 20 comprise a plurality of bristle elements such as 22 (see FIG. 2). FIG. 3 shows a plurality of exemplary individual bristles 22 being gathered together for use in a cosmetic brush.

Pony Hair Characteristics

As will be seen, a significant part of this discussion relates to the substitution of a synthetic material for pony hair in cosmetic brushes. Thus a discussion is first made of the characteristics of pony hair.

Figure 4:
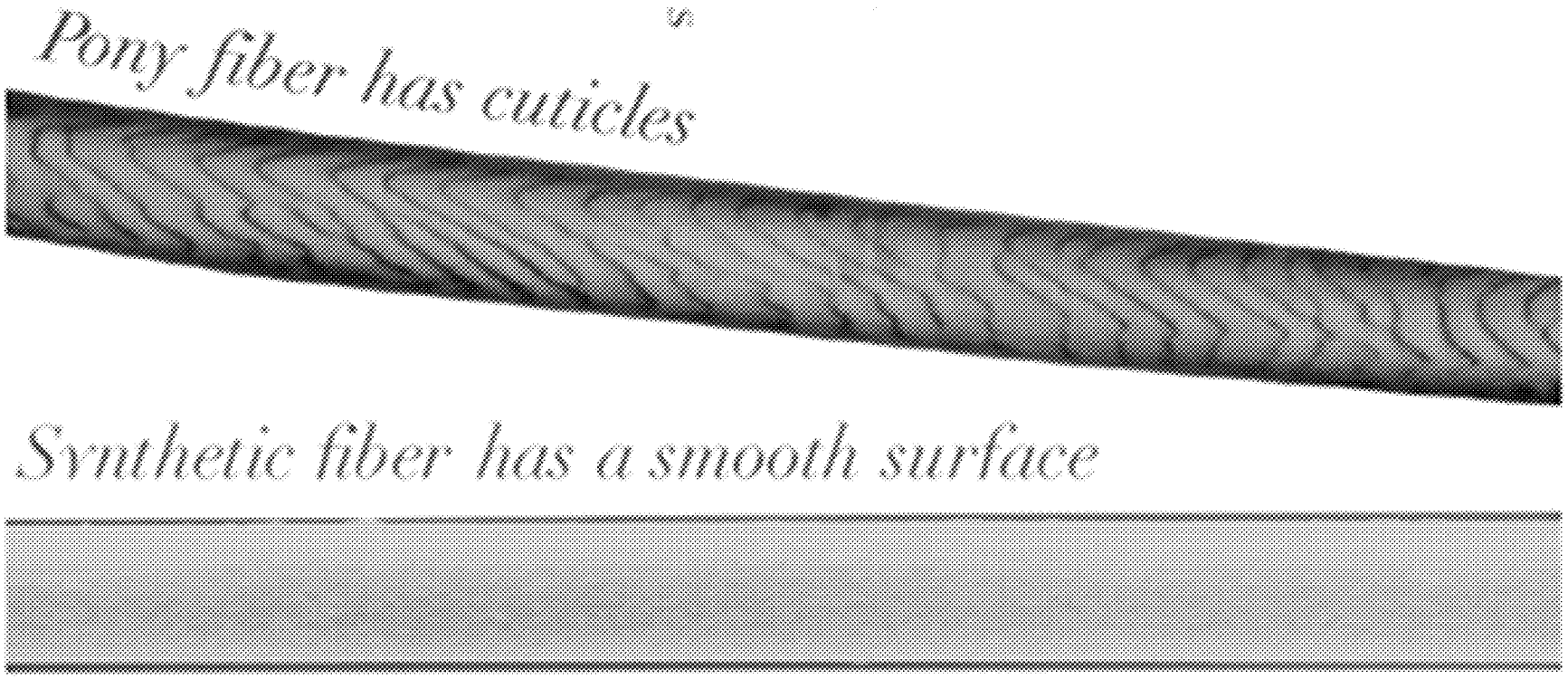
FIG. 4 shows pony hair with cuticles, and synthetic hair without.

Pony hair is soft, thin natural fiber that comes from horses. Pony hair has historically been found suitable for use in eye and face brushes. The cuticles of natural pony hair tend to provide high powder pickup (see FIG. 4). Pony hair likewise tends to have a consistent diameter, cylindrical shape, and almost no tip (naturally short tipped), which provides certain pickup and dispensing characteristics.

Brush heads with pony hair tend to have a high density; the powder pick up is dense and the payoff on the skin is very opaque.

Issues With Pony

Although natural pony hair has the above advantages, there are likewise drawbacks to its use. As it must be removed from the hide of animals, its harvesting process tends to be effort- and cost-intensive, resulting in higher costs of the final product. Quality of natural pony hair can also be sporadic, which is disadvantageous when being integrated into a manufacturing process; it has been found that different batches of hair may need different types of treatment, and additional dressing process may be necessary. Taping processes and hair retention may be negatively impacted.

Other challenges with natural pony hair include decreased quality, increased cost, broken hair in the bundles, hair breakage and fallout, not many pony vendors, and high demand.

Demand is high, color is not easy to control, and its crevices tend to trap product, dirt, and skin oils which can cause bacteria to grow and increase skin irritation. Allergies to animal hair can also be a factor.

Consumer awareness likewise has in impact on the desirability of the product and its corresponding acceptance by the consumer; consumers and companies request more information to allow to make better purchase decisions. The origin of the natural hair used for making brushes is relevant, as is the manner in which the natural hair is obtained. Animal cruelty is condemned, so great efforts must be made to oversee that the harvesting of the hair is done in a humane manner.

Benefits of Synthetic Brush Fibers

In light of the above challenges with natural pony hair, the inventor has noted the benefits of synthetic brush fibers as a possible replacement, noting that synthetic brush fibers can be hygienic, cost effective, durable, do not shed, and can be controllable and fully customizable. They can be dyed in any color, are cruelty free, versatile—(good with any cosmetic formula), good for sensitive skin, do not bleed color, and less prone to stains.

When selecting a synthetic fiber, the characteristics which are considered in such substitution include softness of fiber, thin diameter, improved powder pick up, precise product placement, vibrant payoff, a compact brush head, natural brown color capability, elasticity of brush head, and good color match.

Pony Synthetic Options: PnP Fiber

After researching and understanding the characteristics of Pony hair, the present invention has developed a synthetic option based and inspired by the natural fiber. One name of this new fiber is "PnP" Fiber which shall be considered a trademark of Anisa International for the purposes of this discussion. The fiber is made of PBT (Polybutylene Terephthalate), with a mix of two diameters of fibers, 0.05 mm diameter and 0.07 mm diameter, with the ratio of the blend being 8:2 (8 parts 0.05 mm diameter and 2 parts 0.07 mm diameter). The tips used on both types of fibers is a "short tip", and the wave characteristic of both types of fibers is "small wave". Such specifications are shown in FIG. 5.

The First Embodiment Blend

Under one embodiment of one invention, the blend is 8 parts 0.05 mm diameter PBT (Polybutylene terephthalate) fibers randomly intermixed with 2 parts 0.07 mm diameter PBT fibers. In this embodiment the fibers are 40 mm long, exhibit "small wave" explained later and have free (aka "working") ends exhibiting a "short tip", explained later.

The following chart shows this embodiment:

| First Fiber | Second Fiber | Ratio of First Fiber to Second Fiber |
|---|---|---|
| 0.05 mm diameter PBT | 0.07 mm diameter PBT | 8:2 |
| 40 mm long | 40 mm long | |
| Small wave | Small wave | |
| Short tip | Short tip | |

Small Wave—Definition

Figure 6:
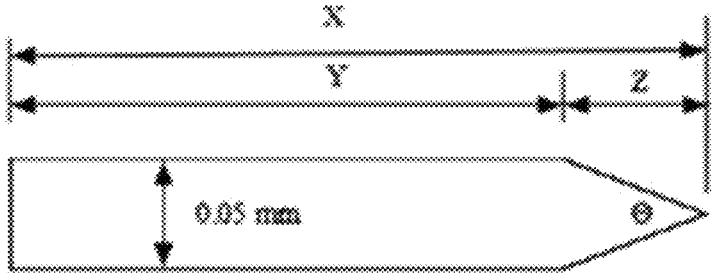
FIG. 6 shows short tip dimensions.
Figure 6:
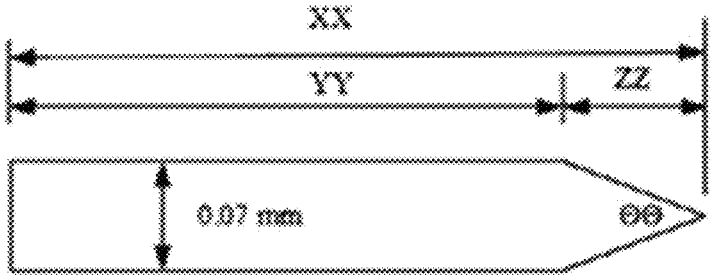
Figure 7:
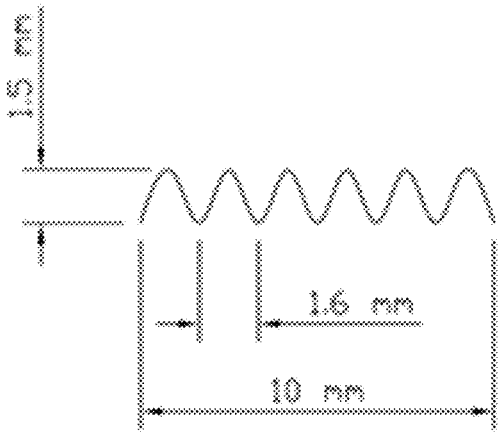
FIG. 7 shows dimensions for a synthetic fiber having a "small wave" characteristic. This is defined as a fiber having waves a total of 1.5 mm high (from top to bottom as shown in the figure), with waves being 1.6 mm long, with approximately 6 waves per 10 mm length.

Elsewhere in this application, the use of a synthetic fiber having a "small wave" characteristic is noted. This is defined as a fiber having waves a total of 1.5 mm high (from top to bottom as shown in the figure), with waves being 1.6 mm long, with approximately 6 waves per 10 mm length, as shown in FIG. 6.

The fiber crimping process used to provide such a wave pattern is as known in the art.

"Short Tips"—The Tipping Process

As noted before, natural pony hair has a relatively "short" tip. Because of the short tip, the hair has a scratchy feel but is good for powder pickup.

In one embodiment of the present invention, a chemical tipping process is used to provide similar short tips to the synthetic fiber. Here is a description of the "short tip" tipping process for the following two types of fibers:

0.05 mm diameter, 40 mm long 0.07 mm diameter, 40 mm long

Hair Dimension 0.05 mm Diameter, 40 mm Long

Reference is made to FIG. 6. Here are certain specifications for this diameter fiber and its related tipping processes:

Tip type: Short Tip

Tipping solution: NaOH (Sodium hydroxide), having a concentration of 44.5+/−2, diluted with water.

Concentration: 44.5+/−2 percent

Temperature: 135'C+/−2 degrees C.

Time: 17 min+/−1 min

Length tip is dipped into solution: 5 mm~6 mm+/−1 mm

Final tip length: 1 mm+/−0.2 mm

The process is as follows. A PBT fiber having a dimension of 0.06 mm diameter and 40 mm long is suspended from above a tipping solution such that a downwardly extending end of the fiber can be dipped into the solution. The tipping solution is NaOH (sodium hydroxide) having a concentration of 44.5+/−2, diluted with water, at a temperature of 135'C.+/−2. The downwardly extending end of the fiber is dipped into the tipping solution for about 17 min+/−1 min. The length of the tip which is dipped into solution is 5 mm~6 mm+/−1 mm. The final tip length is approximately 1 mm+/−0.2 mm. Said another way, the solution removes approximately 4 mm and 1 mm is left. This is the Z dimension in FIG. 6.

Hair Dimension 0.07 mm Diameter, 40 mm Long

Reference is made to FIG. 6. Here are certain specifications for this diameter fiber and its related tipping processes:

Tip type: Short Tip

Tipping solution: NaOH (Sodium hydroxide), having a concentration of 44.5+/−2, diluted with water.

Concentration: 44.5+/−2 percent

Temperature: 132 degrees C.+/−2 degrees C.

Time: 17 min+/−1 min

Length tip is dipped into solution: 5 mm~6 mm+/−1 mm

Final tip length: 1 mm+/−0.2 mm

The process is as follows. A PBT fiber having a dimension of 0.075 mm diameter and 40 mm long is suspended from above a tipping solution such that a downwardly extending end of the fiber can be dipped into the solution. The tipping solution is NaOH (sodium hydroxide) having a concentration of 44.5+/−2, diluted with water, at a temperature of 132 degrees C.+/−2 degrees. The downwardly extending end of the fiber is dipped into the tipping solution for about 17 min+/−1 min. The length of the tip which is dipped into solution is 5 mm~6 mm+/−1 mm. The final tip length is approximately 1 mm+/−0.2 mm. Said another way, the solution removes approximately 4 mm and 1 mm is left. This is the ZZ dimension in FIG. 6.

Mixture of the Fibers

The fibers are mixed randomly within the head but all have the same tip.

The process of intermingling the two types of fiber is conventional and as known in the art.

Length of the Fibers

In one version, the length is at minimum 35 mm in length (min length×parameter in FIG. 6). The total length of the fiber might be variable due to the final application result desired.

The length from the tip of the bristle to where the ferrule starts really varies—it could be from a minimum on 2 mm to maximum of 35 mm.

Fiber Color

Under one version of the invention, the color of the synthetic fibers is selected to be substantially similar to the color of natural brown color pony hair. Fibers of mixed color types could be intermingled to achieve natural brown color. Other colors could also be used, including red brown fiber, yellow brown fiber, and white fiber. Pigment types used in the fibers could include brown, black, orange, red, and yellow.

Extrusion Fiber Type

Here are some technical dimensions of two types of extruded fibers used herein, namely 0.05 mm PBT and 0.07 mm PBT:

Processing of 0.05 mm PBT

In order to arrive at a bundle of 0.05 mm PBT for use under one aspect of the present invention, raw material filament of 0.06 diameter is originally selected, as the tipping process starts with a thicker diameter hair and ends up with a thinner diameter hair. This is because the solution seeps into the bundle from the tips. Although only the top part of the bundle is dipped into the solution, the length of the bundle is affected by the tipping solution. The liquid is absorbed inside the bundle as well.

The raw material filament is slightly thicker (e.g. on average 0.06 mm diameter), compared to the final hair. Once the 0.06 diameter hair has been tipped, the tipping process tends to make the hair thinner, because the solution has been drawn into the length of the bundle by capillary action.

The final thickness varies from hair to hair and one process according to the invention includes an acceptable range for the thickness of hairs. This means that in a bundle of finished 0.05 mm PBT, due to a tolerance of +/−0.01 mm, the bundle can include 0.06 mm or 0.04 mm PBT hair. The diameters of the hairs are measured and if the average of the diameters is 0.05 mm, the hairs are accepted.

Processing of 0.07 mm PBT

In order to arrive at a bundle of 0.07 mm PBT for use under one aspect of the present invention, raw material filament of 0.075 diameter is originally selected, as the tipping process starts with a thicker diameter hair and ends up with a thinner diameter hair.

The raw material filament is slightly thicker (e.g. on average 0.075 mm diameter), compared to the final hair.

Once the 0.0075 diameter hair has been tipped, the tipping process tends to make the hair thinner, for capillary reasons.

The final thickness varies from hair to hair and one process according to the invention includes an acceptable range for the thickness of hairs. This means that in a bundle of finished 0.07 mm PBT, due to a tolerance of +/−0.01 mm, the bundle can include 0.08 mm or 0.06 mm PBT hair. The diameters of the hairs are measured and if the average of the diameters is 0.07 mm, the hairs are accepted.

Additional Blends

There are other suitable blends of fibers which could vary depending on the cosmetic products they may be used with. For example, the PnP fiber mixture shown and describer above is suitable for eye brushes, which usually are shorter and use less hair then face brushes.

PnP fiber brushes which could be used for face brushes could include different hair lengths, thicknesses, and waves.

Natural pony has also in the past been used also for creating face brushes (blush brushes) and small face brushes. Thus, the present invention also contemplates use of PnP also for face brushes. Depending on the needed length of the fiber, the hair length, thickness and waviness of PnP might have to be changed.

Possible additional blends include but are not limited to:

0.04 mm short tip, small wave 0.05 mm short tip, small wave 0.07 mm short tip, small wave 0.08 mm short tip, small wave The four versions listed above can be used as one type of fiber for substitute pony and could be used blended, with each other.

Note also that any blend could be used that has 0.05 mm PBT fiber with short tip and 0.07 mm PBT short tip in any ratio (1:9, 2:8, 3:7 etc.)—all straight to medium wave—for natural hair substitution.

CONCLUSION

Various modifications and variations can be made in the present invention without departing from the spirit or scope of the invention.

Although the description herein has been made with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

What is claimed is:

1. A cosmetic brush comprising a cosmetic brush head, said brush head comprising a blend of two fibers, said blend comprising:

a first plurality of fibers each having a predetermined length and a 0.05 mm diameter; and a second plurality of fibers each having a predetermined length and a 0.07 mm diameter, wherein the ratio of said blend being 8:2 (8 parts 0.05 mm diameter to 2 parts 0.07 mm diameter).

2. The cosmetic brush of claim 1, wherein at least one of said plurality of fibers includes individual fibers each made of a synthetic material.

3. The cosmetic brush of claim 1, wherein each of said plurality of fibers includes individual fibers each made of a synthetic material.

4. The cosmetic brush of claim 1, wherein at least one of said plurality of fibers includes individual fibers each made of Polybutylene Terephthalate (PBT).

5. The cosmetic brush of claim 1, wherein each of said plurality of fibers includes individual fibers each made of Polybutylene Terephthalate (PBT).

6. The cosmetic brush of claim 1, wherein at least one of said plurality of fibers includes individual fibers each having a short tip at its working end.

7. The cosmetic brush of claim 1, wherein each of said plurality of fibers includes individual fibers each having a short tip at its working end.

8. The cosmetic brush of claim 1, wherein at least one of said plurality of fibers includes individual fibers each having a small wave characteristic.

9. The cosmetic brush of claim 1, wherein each of said plurality of fibers includes individual fibers each having a small wave characteristic.

10. The cosmetic brush of claim 1, wherein each of said plurality of fibers includes individual fibers each having a small wave characteristic wherein the small wave characteristic is 1.5 mm from top to bottom and the length of each wave is 1.6 mm.

11. The cosmetic brush of claim 1, further comprising a ferrule, and wherein the first plurality of fibers and second plurality of fibers extend from the ferrule.

12. The cosmetic brush of claim 11, wherein the brush head fans outward from the ferrule.

13. The cosmetic brush of claim 11, wherein the first plurality of bristles and second plurality of bristles define a domed end of the brush head opposite the ferrule, the domed end defining a circular cross-section.

14. The cosmetics brush of claim 1, wherein each of the bristles defines a brown color.

15. The cosmetic brush of claim 11, further comprising a handle coupled to the ferrule.

16. The cosmetic brush of claim 15, wherein the ferrule tapers towards the handle.

17. A cosmetic brush head, said brush head comprising a blend of two fibers, said blend comprising:

a first plurality of fibers each having a predetermined length and a 0.05 mm diameter; and a second plurality of fibers each having a predetermined length and a 0.07 mm diameter, wherein the ratio of said blend being 8:2 (8 parts 0.05 mm diameter to 2 parts 0.07 mm diameter) and wherein said first and second pluralities of fibers are intermixed.

18. The cosmetic brush head of claim 17, wherein at least one of said plurality of fibers includes individual fibers each made of a synthetic material.

19. The cosmetic brush head of claim 17, wherein each of said plurality of fibers includes individual fibers each made of a synthetic material.

20. The cosmetic brush head of claim 17, wherein at least one of said plurality of fibers includes individual fibers each made of Polybutylene Terephthalate (PBT).

21. The cosmetic brush head of claim 17, wherein each of said plurality of fibers includes individual fibers each made of Polybutylene Terephthalate (PBT).

22. The cosmetic brush head of claim 17, wherein at least one of said plurality of fibers includes individual fibers each having a short tip at its working end.

23. The cosmetic brush head of claim 17, wherein each of said plurality of fibers includes individual fibers each having a short tip at its working end.

24. The cosmetic brush head of claim 17, wherein at least one of said plurality of fibers includes individual fibers each having a small wave characteristic.

25. The cosmetic brush head of claim 17, wherein each of said plurality of fibers includes individual fibers each having a small wave characteristic.

26. The cosmetic brush head of claim 17, wherein each of said plurality of fibers includes individual fibers each having a small wave characteristic wherein the small wave characteristic is 1.5 mm from top to bottom and the length of each wave is 1.6 mm.

* * * * *